United States Patent [19]

Yamatani

[11] Patent Number: 4,790,732

[45] Date of Patent: Dec. 13, 1988

[54] DRIVING MEANS OF THE TRIPLE-CYLINDER PLUNGER PUMP

[76] Inventor: Yoshichi Yamatani, 1870 Manazuru, Manazuru-machi Ashigarashimogun, Kanagawa-ken, Japan

[21] Appl. No.: 122,517

[22] Filed: Nov. 19, 1987

Related U.S. Application Data

[63] Continuation of Ser. No. 911,482, Sep. 25, 1986, abandoned, which is a continuation of Ser. No. 753,104, Jul. 9, 1985, abandoned.

[30] Foreign Application Priority Data

Jul. 31, 1984 [JP] Japan ..... 59-119200[U]

[51] Int. Cl.[4] ..... F04B 11/00

[52] U.S. Cl. ..... 417/539

[58] Field of Search ..... 417/539, 437

[56] References Cited

U.S. PATENT DOCUMENTS

| | | | |
|---|---|---|---|
| 1,070,706 | 8/1913 | Luitwieler | 74/55 |
| 2,882,831 | 4/1959 | Dannevig | 91/499 |
| 4,028,018 | 6/1977 | Aodsley | 92/13.3 |
| 4,352,636 | 10/1982 | Patterson | 417/465 |
| 4,556,371 | 12/1985 | Post | 417/539 |

FOREIGN PATENT DOCUMENTS

| | | | |
|---|---|---|---|
| 1801142 | 4/1970 | Fed. Rep. of Germany | 417/426 |
| 2446805 | 4/1976 | Fed. Rep. of Germany | 417/539 |
| 2706685 | 8/1978 | Fed. Rep. of Germany | 417/539 |
| 248234 | 12/1925 | United Kingdom | 417/536 |
| 509039 | 7/1939 | United Kingdom | 417/539 |

*Primary Examiner*—Donald E. Stout

*Attorney, Agent, or Firm*—Steele, Gould & Fried

[57] ABSTRACT

In a triple cylinder plunger pump, each of the plungers is respectively actuated by one of three disc cams which are respectively connected to a common driving shaft and to a plunger. The three cams are identical in size and in contour and are positioned about the driving shaft with a phase angle of 120° therebetween. Each disc cam is formed to have a contour consisting of two portions for urging each plunger to perform both a reciprocal discharge stroke and a suction stroke. The two portions are each respectively designed with a positive acceleration range, a constant speed range and a negative acceleration range. The system is so balanced that the pressure drop of any one plunger due to its negative acceleration motion can be compensated by positive acceleration motion of the next subsequently reciprocating plunger, whereby the discharge pressure of the pump is maintained substantially constant and pulsation in the discharge volume and in the suction volume is kept to a minimum.

2 Claims, 2 Drawing Sheets

DRIVING MEANS OF THE TRIPLE-CYLINDER PLUNGER PUMP

This is a continuation of application Ser. No. 911,482, filed Sept. 25, 1986, and now abandoned, which is a continuation of application Ser. No. 753,104, filed July 9, 1985, now abandoned.

BACKGROUND OF THE INVENTION

1. Field of the Invention

The present invention relates to an actuating device of a triple cylinder plunger pump means which can reduce the ratio of pulsation caused by variation in the discharge volume and the suction volume, stabilize its load to its rotary driving shaft and accomplish smooth running of the related parts and components of the plunger pump.

2. Description of the Prior Art

In a triple cylinder plunger pump which has heretofore been used, each plunger is generally actuated by a respective crank being rotated in uniform circular motion through a connecting rod coupled to the crank. since the actuating member utilizes a reciprocating slider crank mechanism, the motion speed diagram of each plunger can be expressed by a quasi-sinusoidal curve. In such a plunger pump, there inevitably occurs a phenomenon of pulsation due to the variation in the plunger velocity during its discharge stroke as well as its suction stroke.

The actual driving horse power required for such a triple cylinder plunger pump at a relatively lower speed of rotation (100 r.p.m.–200 r.p.m.) will generally become 1.2–1.05 times of the theoretical fluid horse power due to the aforesaid pulsation, even if the mechanical efficiency of the pump could be considered as 100%.

When the pump is worked at a higher discharge pressure, both the suction valve and the discharge valve will display a remarkable delay in action at high speed rotation, which delay gives rise to a great decrease in volumetric efficiency, thus resulting in a substantial increase in its ratio of pulsation. Under such conditions, the motion speed diagram of the plungers would no longer be expressed by a quasi-sinusoidal curve.

SUMMARY OF THE INVENTION

The present invention aims to solve such drawbacks as have been encountered in the prior art types of triple cylinder plunger pumps which are actuated by a slider crank mechanism by adopting an improved actuating mechanism which can actuate each plunger in a more exact manner by each of a plurality of disc cam means. Thereby, the present invention aims to provide a plunger pump of simplified construction which is capable of accomplishing its pumping action with a constant discharge pressure and with a reduced ratio of pulsation in the discharge volume and the suction volume. The plunger pump of the present invention ensures a stabilized load upon the driving shaft with accompanying smooth running of the related members, and thereby provides for longer service life of the accessories as well as that of the main pump bodies.

The inventive feature of the present invention resides in a design whereby both the discharge and suction motions of each plunger of a triple cylinder plunger pump are directly actuated by each of the disc cams which are connected to a common driving shaft. The shaft is rotated in a uniform circular motion and each of the disc cams has a continuous outside peripheral surface of suitable contour to urge each respective plunger to make a linear reciprocal movement for effecting both a suction and a discharge of working fluid per each rotation. The contour of the portion of the cam for effecting discharge action consists of three ranges, that is, a positive acceleration range, a constant speed range and a negative acceleration range. Similarly, the other portion of the cam for discharge action is formed to have a positive acceleration range, a constant speed range and a negative acceleration range. Moreover, in determining the above-mentioned three different ranges, motion delays of the suction valve and the discharge valve have been taken into account, with the intention that the pulsation ratio of both the discharge volume and the suction volume can be minimized. Additionally, the angle of rotation of each disc cam in the discharge from the starting point of positive acceleration to the starting of negative acceleration is set at 120° together with an angular phase shift of 120° one after another between adjacent disc cams.

BRIEF DESCRIPTION OF THE DRAWINGS

The drawings show an embodiment of the present invention, in which.

DESCRIPTION OF THE PREFERRED EMBODIMENTS

Explanation will now be made, by referring to the accompanying drawings, of a preferred embodiment of the present invention incorporated into a three cylinder plunger pump.

Figure 1:
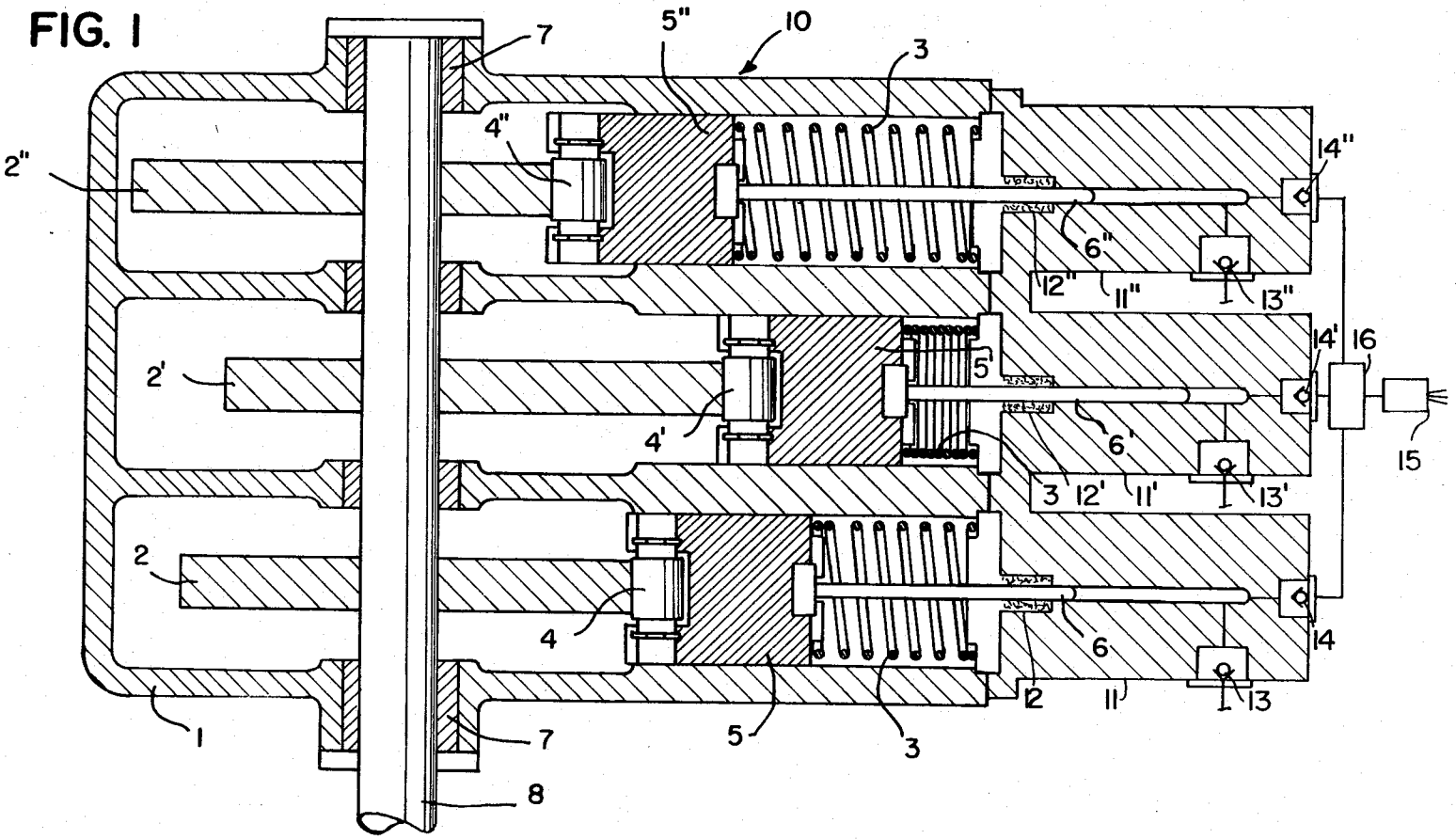
FIG. 1 is a cross sectional plan view showing the actuating means of the plunger pump of the present invention.

FIG. 1 shows the actuating section of the triple cylinder plunger pump 10. In the drawings, cams 2, 2' and 2'' having the same size and contour are received in a case or housing 1, wherein each cam is respectively connected via a roller 4, 4', 4'' to a reciprocating drum 5, 5', 5''. Each drum is biased by a compression spring 3 and is responsive to the rotation of a cam shaft 8. The cam shaft 8 is rotatively carried in bearings 7 and is used as a common shaft for rotation of the cams 2, 2', 2'' so that these cams can cooperatively actuate the respective plunger rods 6, 6', 6'' which are connected to similar reciprocating drums 5, 5', 5''.

The plunger rods 6, 6', 6'' are reciprocal within the respective cylinders 11, 11', 11'' and are sealed by the respective packings 12, 12', 12''. Each cylinder 11, 11', 11'' is equipped with a suction valve 13, 13', 13'' and a discharge valve 14, 14', 14''. As illustrated, the plurality of discharge valves 14, 14', 14'' are interconnected to feed the discharge nozzle 15 through a common distribution connector 16.

Figure 2:
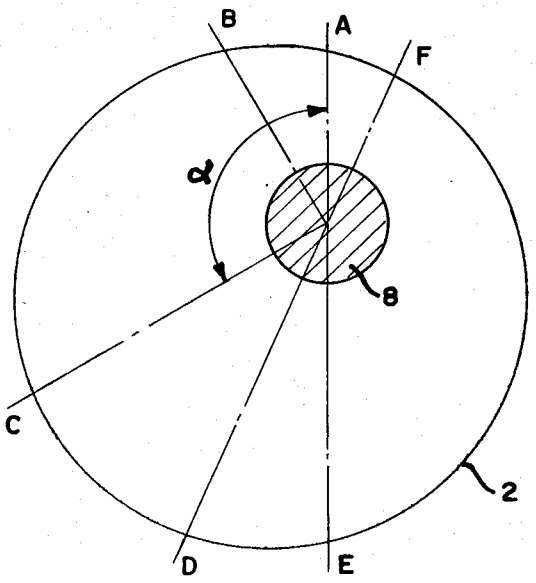
FIG. 2 is a schematic view showing the contour of a cam.

All of the three cams 2, 2' and 2'' are fabricated the same both in size and in contour, each having a discharge stroke portion AD and a suction stroke portion DA as shown in FIG. 2.

Figure 3:
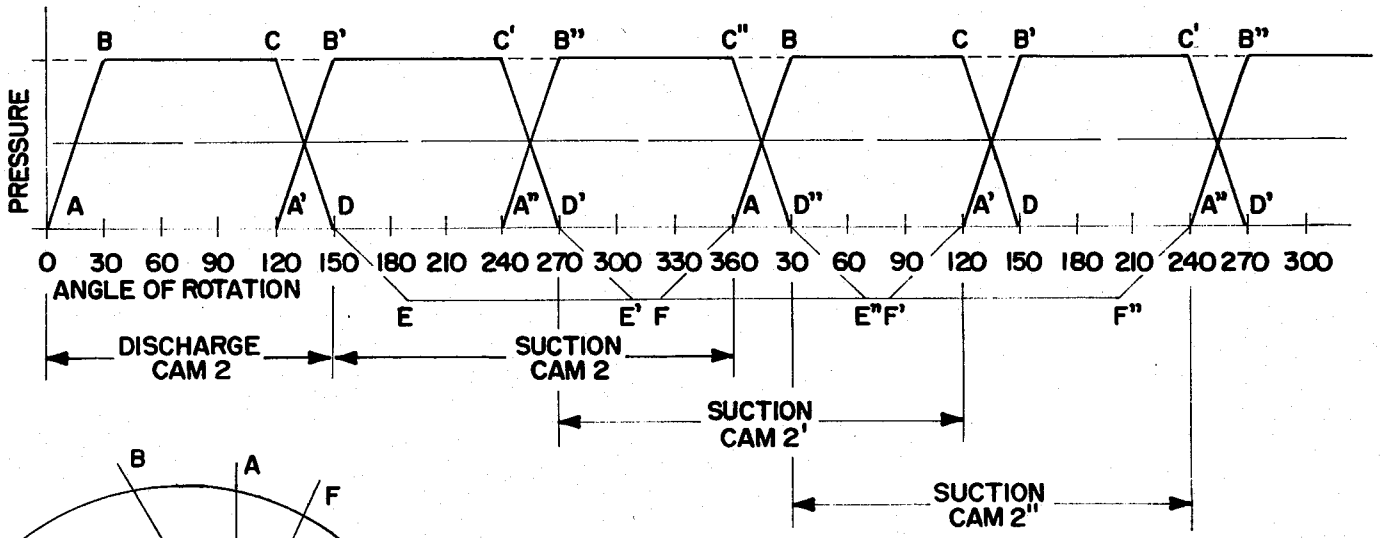
FIG. 3 is a diagram showing a relation between the angle of rotation of the cam and the pressure and the discharge volume of the working fluid.

The contour of the discharge stroke section AD is further divided into three ranges, namely, a positive acceleration range AB, a constant speed range BC, and a negative acceleration range CD. Similarly, the suction stroke portion DA is also divided into three ranges, a positive acceleration range DE, a constant speed range EF and a negative acceleration range FA. As shown in FIG. 3, the discharge pressure increases from zero at starting point A of the positive acceleration range AB to a maximum of the end B of the positive acceleration range. The pressure remains maximum through the constant speed range BC and reduces from maximum at staring point C of the negative acceleration range CD to zero at point D at the end of the negative acceleration range.

As illustrated graphically in FIG. 3, the angle of rotation of each cam 2, 2′ and 2″ which is formed between the starting point A of the positive acceleration range AB and the starting point C of the negative acceleration range CD is set at 120° and the cams 2, 2′ and 2″ are angularly spaced apart, one after another, with a shift angle of 120°.

Accordingly, when the cam shaft 8 is rotated, each plunger rod 6, 6′, 6″, being driven by a respective cam 2, 2′ and 2″, will repeat cyclic reciprocal movements consisting of, a positive acceleration stroke from the point A to point B of the cam; a constant speed stroke from the point B to point C; a negative acceleration stroke from the point C to point D; a positive acceleration stroke of the suction stroke from the point D to point E; a constant speed stroke from the point E to point F and finally a negative acceleration stroke from the point F again to the point A to complete one cycle and to be repeated in subsequent cycles.

Since the angle of rotation of each cam from the point A to the point C is set at 120° and as each cam is angularly spaced apart by 120°, one after another, when the point C of the first cam 2 reaches the contact zone of the roller 4, the second cam 2′ is rotated to a position to start its positive acceleration motion at the point A′. Similarly, when the point C′ of the second cam 2′ reaches the contact zone of the roller 4′, the third cam 2″ will start its positive acceleration motion.

By suitably designing, under such conditions, the contours of the cams, the position of the cross point of the pressure decrease curve of the first plunger as affected by the negative acceleration range of the first cam 2 with the pressure increase curve of the second plunger as affected by the positive acceleration of the second cam 2′ can be adjusted such that the rotational torque applied to the shaft 8 can be maintained constant. In addition, the sum of the discharge pressure produced by the first plunger and the second plunger also can be made substantially equal to that given by the first plunger during its constant speed stroke.

According to the present invention, contour common to the cams 2, 2′ and 2″ is selected such that the length of time for the suction stroke of each plunger is set to 1.4 times that of the discharge stroke so as to compensate for possible motion delay of the related suction valves.

As explained above, in the plunger pump of the present invention, since the pressure variation in one plunger pump cylinder can be compensated by the pressure variation of the other plunger pump cylinder, the occurrence of pulsation in the pump will be maintained at to an extremely low level. Accordingly, there exists no need to provide any supplemental means such as an accumulator or the like to compensate for pulsation. In addition, as the stress applied to the cam shaft will also be kept substantially constant, there is no fear of generating loud sounds such as might be caused by frictional noise. Damage to the components of the pump can also be prevented by the inherent balancing forces in the system to therefore assure long periods of service life.

The meritorious effects of the present invention can be summarized as follows:

(1) The plunger pump can be operated in a very exact and effective manner by means of direct actuation by a set of cams having a particularly designed contour line.

(2) The pressure drop in one plunger pump cylinder can simultaneously be compensated by the pressure forces in another plunger pump cylinder, thus assuring that there will be no appreciable pulsation in discharge pressure.

(3) It is possible to keep the load upon the rotary driving shaft constant and suitable for very high pressure pumping.

(4) Damage to the parts and accessories is considerably less, whereby the service life of the device as a whole can be extended.

(5) The plunger pump is very simple in construction as compared with conventional reciprocating slider crank mechanisms which are usually employed in this type of plunger pump construction.

(6) The plunger pump requires no accumulator for successful operation.

(7) The efficiency of suction is increased.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A triple cylinder plunger pump of the type having a rotatable cam shaft and wherein each cylinder comprises a reciprocating drum, a plunger connected to the drum, a suction valve to control suction volume and a discharge valve to control discharge volume, the pump having a pulsation ratio between the discharge volume and the suction volume comprising a plurality of three disc cams rotated by the said cam shaft to respectively actuate the plungers, the disc cams being rotated in a uniform circular motion by the cam shaft, each said disc cam being angularly offset from another disc cam by 120 degrees;

the said plungers each being respectively in contact with one of the disc cams through one of said drums and each plunger being adapted for reciprocal discharge motion and suction motion, each cylinder being equipped with a roller interposed between the drum and its associated disc cam, and a spring, the spring being adapted to bias the drum toward its associated disc cam;

each of said disc cams being formed to have an outer peripheral contour consisting of two portions, a first discharge portion for actuating said plunger discharge motion and a second suction portion for actuating said plunger suction motion;

each of the said discharge portion and suction portion in each disc contour comprising three different ranges, namely, a positive acceleration range, a constant speed range and a negative acceleration range, the angle of rotation of the positive acceleration range from zero to maximum pressure in the discharge portion being 30 degrees, the angle of rotation of the constant speed range of the discharge portion at maximum pressure being 90 degrees, the angle of rotation of the negative acceleration rage of the discharge portion from maximum pressure to zero being 30 degrees, the angle of rotation of the positive acceleration range of the suction portion plus the angle of rotation of the constant speed range of the suction portion, and the angle of rotation of the negative speed range of the suction portion being 210 degrees;

the said discharge portions of the cams producing a discharge pressure, the discharge pressure increasing from zero to a maximum operating pressure during the positive acceleration range, the discharge pressure remaining constant at the maximum pressure during the constant speed range and the discharge pressure decreasing from the maximum pressure to zero during the negative acceleration range;

the three different ranges in the discharge portion and the three different ranges in the suction portion of each cam being determined to maintain the pulsation ratio in the discharge volume and in the suction volume to a minimum, the disc cams being oriented relative to one another so that when a first disc cam is rotated to the end of its constant speed range, a second disc cam is rotated to start its positive acceleration range, the disc cams being so oriented relative to one another that the sum of the discharge pressures produced by the acceleration range of a first cam and the negative acceleration range of a second cam is substantially equal to the maximum pressure to thereby maintain a substantially constant discharge pressure; and the said suction portion of the contour of each disc cam being selected so that its associated plunger, when in its suction motion takes a time period of 1.4 times greater than that of the plunger when in its discharge motion, whereby any motion delay of the related suction valve will be compensated.

2. The triple cylinder pump of claim 1 wherein the angle of rotation of the positive acceleration range combined with the constant speed range of each cam is 180 degrees in the said second portion of each cam.

* * * * *